US008382109B2

(12) United States Patent
Tsuji et al.

(10) Patent No.: US 8,382,109 B2
(45) Date of Patent: Feb. 26, 2013

(54) SHEET CONVEYING APPARATUS AND IMAGE FORMING APPARATUS

(75) Inventors: Hiroharu Tsuji, Numazu (JP); Masayoshi Fukatsu, Suntou-gun (JP); Atsushi Ogata, Mishima (JP); Junichi Sekiyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/271,740

(22) Filed: Oct. 12, 2011

(65) Prior Publication Data

US 2012/0025455 A1 Feb. 2, 2012

Related U.S. Application Data

(62) Division of application No. 12/017,867, filed on Jan. 22, 2008, now Pat. No. 8,061,712.

(30) Foreign Application Priority Data

Jan. 26, 2007 (JP) ..... 2007-015799
Jan. 18, 2008 (JP) ..... 2008-008740

(51) Int. Cl.
*B65H 39/10* (2006.01)

(52) U.S. Cl. ..... 271/303

(58) Field of Classification Search ..... 271/303
See application file for complete search history.

(56) References Cited

U.S. PATENT DOCUMENTS

| | | | |
|---|---|---|---|
| 6,206,369 | B1 | 3/2001 | Hoshii et al. |
| 6,273,419 | B1 | 8/2001 | Allen et al. |
| 6,332,611 | B1 | 12/2001 | Tomita |
| 6,382,614 | B1 | 5/2002 | Fukatsu et al. |
| 6,382,616 | B1 | 5/2002 | Waragai et al. |
| 6,561,503 | B1 | 5/2003 | Ogata et al. |
| 6,733,007 | B2 | 5/2004 | Sekiyama et al. |
| 6,912,044 | B2 | 6/2005 | Sekiyama et al. |
| 6,981,636 | B2 | 1/2006 | Gallo-Hendrikx |
| 6,988,729 | B2 | 1/2006 | Tamura et al. |

FOREIGN PATENT DOCUMENTS

JP 2001-39602 2/2001

*Primary Examiner* — Michael McCullough
(74) *Attorney, Agent, or Firm* — Fitzpatrick, Cella, Harper & Scinto

(57) ABSTRACT

A sheet conveying apparatus includes a first sheet conveying path, a second sheet conveying path branched from the first sheet conveying path, a switching member capable of moving in the branch portion of the first sheet conveying path and the second sheet conveying path, and a first regulation member and a second regulation member which regulate the movement of the switching member, wherein when the first regulation member is abutted against the switching member, the first regulation member forms a gap having a first interval through which the sheet can pass to the second sheet conveying path, when the switching member is further moved forward, and when the second regulation member is abutted against the switching member, the second regulation member forms a gap having a second interval smaller than the first interval through which the sheet can pass to the second sheet conveying path.

12 Claims, 8 Drawing Sheets

SHEET CONVEYING APPARATUS AND IMAGE FORMING APPARATUS

This application is a divisional of U.S. patent application Ser. No. 12/017,867, filed Jan. 22, 2008, and allowed Jul. 13, 2011.

BACKGROUND OF THE INVENTION

1. Field of the Invention

The present invention relates to a sheet conveying apparatus in which the periphery of a switching member, which switches a sheet conveying path, can be opened as an access space used to process jam and to an image forming apparatus having the sheet conveying apparatus.

2. Description of the Related Art

Conventionally, an image forming apparatus such as a printer, a copy machine, and the like employs a sheet conveying apparatus for conveying a sheet while switching a sheet conveying direction at the branch portions of a plurality of sheet conveying paths using a switching member. In the sheet conveying apparatus, since sheet jam may occur in the peripheries of the branch portions of the sheet conveying paths, the sheet conveying apparatus is ordinarily provided with an openable/closable exterior cover (hereinafter, referred to as a jam processing door) so that the peripheries of the branch portions can be accessed easily to process the jam.

As an example of the sheet conveying apparatus, there is a sheet conveying apparatus which is mounted on an image forming apparatus main body and can stack sheets, which have images formed thereon, on many trays after they are sorted. The sheet conveying apparatus has a sheet conveying path for convey sheets in a direction where the trays are disposed, a plurality of sheet conveying paths branched from the sheet conveying path to the respective trays, and switching members which switches the conveying directions of the sheets in the respective branch portions. Further, the sheet conveying apparatus is provided with an openable/closable jam processing door so that the peripheries of the branch portions where the respective switching members are disposed can be easily accessed. Accordingly, when jam occurs in the peripheries of the branch portions where the switching members are disposed, a user can extract a jammed sheet by opening the jam processing door.

However, in the sheet conveying apparatus, when the user opens the jam processing door and extracts the jammed sheet to process jam in the peripheries of the branch portions, there is a possibility that the jammed sheet is caught by a switching member in a branch portion and broken. Further, when it is intended to forcibly extract the jammed sheet caught by the switching member in the branch portion, there is also a possibility that the switching member is broken.

As a countermeasure for solving the problem, there is a method disclosed in, for example, Japanese Patent Application Laid-Open No. 2001-39602. According to this method, when a jam processing door is opened, a switching member is evacuated together with the jam processing door in association the opening of the door to thereby open a jam processing space.

However, this technology is defective in that the number of parts, the size of an apparatus, and a cost are increased because parts which cause the jam processing door to be associated with the switching member are necessary although breakage of a jammed sheet and the switching member can be prevented.

SUMMARY OF THE INVENTION

An object of the present invention is to provide a space-saving and low-cost sheet conveying apparatus in which a sheet and a switching member are not broken even if a load is applied to the switching member when jam, which occurs in the periphery of the branch portion of a sheet conveying path, is processed.

To achieve the above object, a sheet conveying apparatus of the present invention includes a sheet conveying apparatus includes a first sheet conveying path, a second sheet conveying path branched from the first sheet conveying path, a switching member capable of moving to a first position which guides a sheet to the first sheet conveying path and to a second position which guides the sheet to the second sheet conveying path in the branch portion of the first sheet conveying path and the second sheet conveying path, and a first regulation member and a second regulation member which regulates the movement of the switching member by being abutted against the switching member moving in the direction from the first position to the second position, wherein when the switching member abuts against the first regulation member, the switching member forms a gap through which the sheet can pass to the second sheet conveying path, the second regulation member is disposed at a position where the switching member abuts against the second regulation member when the switching member is deformed, and when the switching member abuts against the second regulation member, the switching member forms a gap through which the sheet can pass to the second sheet conveying path.

According to the present invention, when a jammed sheet is extracted in the periphery of the branch portion of the sheet conveying paths, breakage of a sheet and the switching member can be prevented without an increase of size and cost of the apparatus.

Further features of the present invention will become apparent from the following description of exemplary embodiments (with reference to the attached drawings).

DESCRIPTION OF THE EMBODIMENTS

Figure 1:
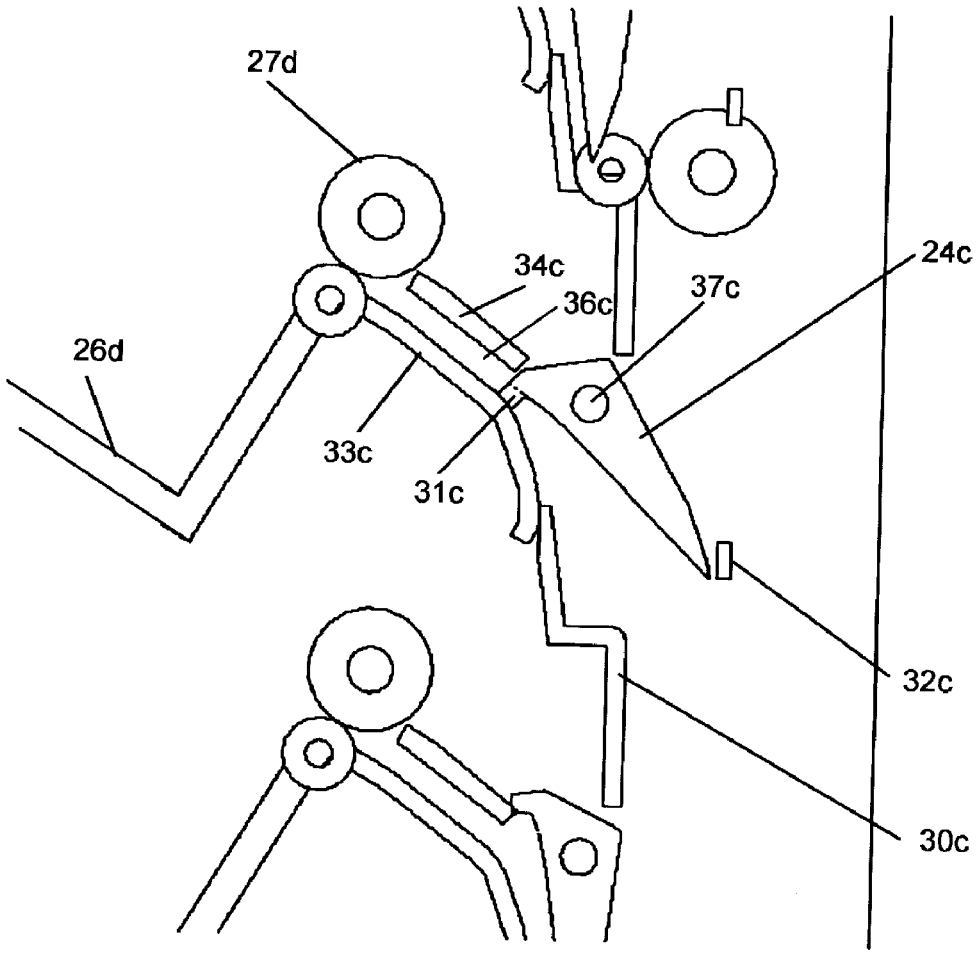
FIG. 1 is a partial sectional view of a sheet conveying apparatus according to a first embodiment.

Preferable embodiments will be explained below in detail as exemplary examples of the present invention referring to the drawings. However, the size, material, shape, relative layout, and the like of the components of the embodiments described in the embodiments shown below are to be appropriately modified by the arrangement and various conditions of the apparatus to which the present invention is applied. Accordingly, the scope of the present invention should not be limited thereto unless specified otherwise.

First Embodiment

Figure 2:
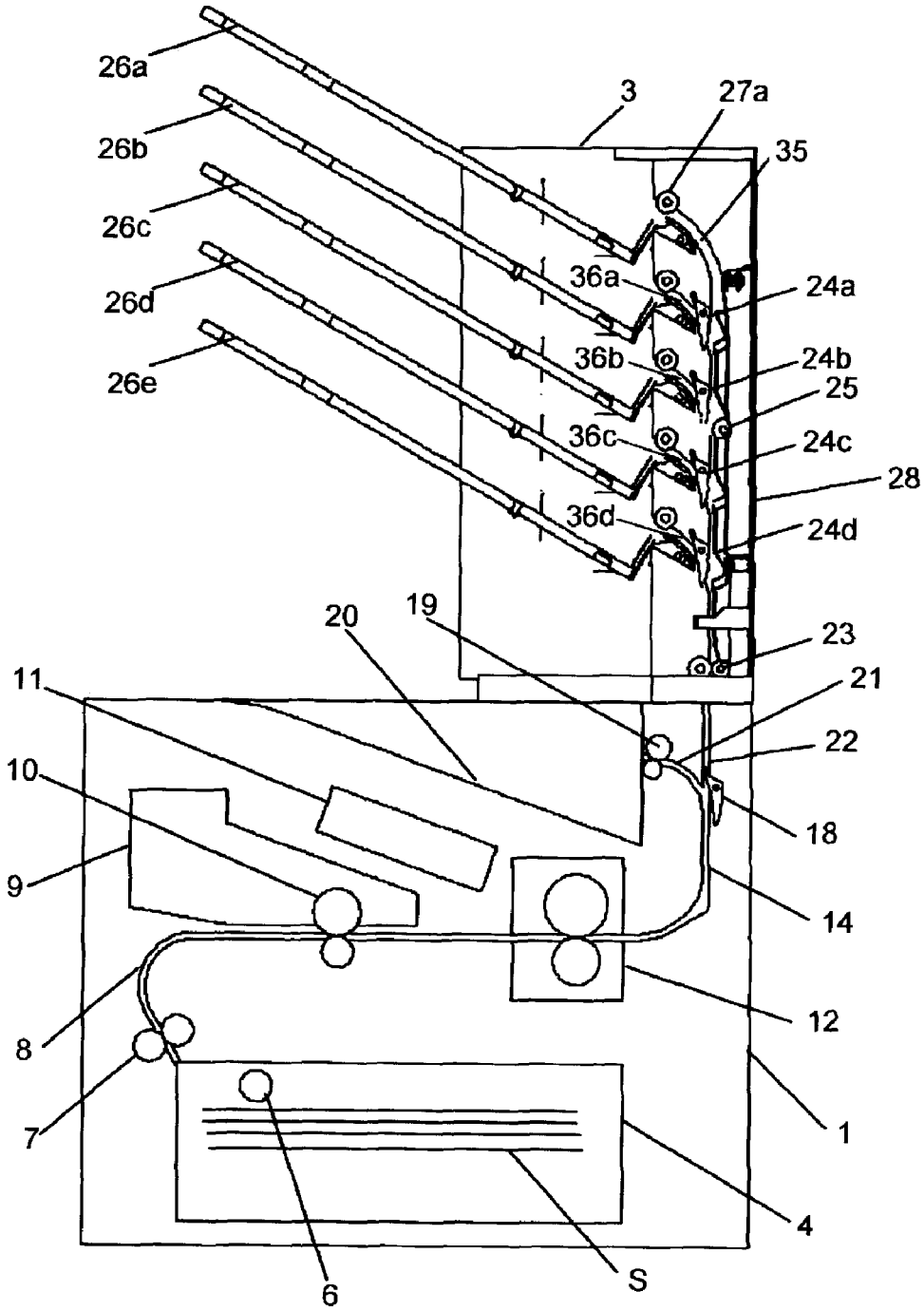
FIG. 2 is a sectional view of an image forming apparatus having the sheet conveying apparatus.

An image forming apparatus having a sheet conveying apparatus according to the first embodiment will be explained. A sheet discharge apparatus capable of sorting sheets to many stack trays is exemplified here as the sheet conveying apparatus. As shown in FIG. 2, the image forming apparatus is arranged such that the sheet discharge apparatus 3 is arranged as an independent unit with respect to an image forming apparatus main body 1 for forming an image on a sheet, and the sheet discharge apparatus 3 is detachably mounted to an upper portion of image forming apparatus main body 1.

As shown in FIG. 2, in the image forming apparatus main body 1, a plurality of sheets S stacked on a sheet feed cassette 4 are separated one by one by a feed roller 6 and separation conveying rollers 7 and conveyed to an image forming process unit (process cartridge) 9 by a conveying guide 8.

The image forming process unit 9 is an image forming portion for forming an image (toner image) by an electrophotographic system. Specifically, an image is formed by illuminating light to a charged photosensitive drum 10 by a laser scanner 11, the image is developed using toner, and the toner image is transferred onto a sheet S.

The sheet 5, onto which the toner image is transferred from the photosensitive drum 10, is conveyed to a fixing unit 12 and applied with heat and pressure force so that the image is fixed.

The sheet 5, onto which the image is fixed, is conveyed to a sheet conveying path 14 for conveying the sheet to an upper portion of the image forming portion. The sheet conveyed to the sheet conveying path 14 is guided to a face down conveying path 21 or a sheet discharge apparatus conveying path 22 by a switching member 18 on the apparatus main body side. The sheet guided to the face down conveying path 21 is discharged onto a face down tray 20 by a face down discharge roller 19. On the other hand, the sheet guided to the sheet discharge apparatus conveying path 22 is sent to the sheet discharge apparatus 3 connected to an upper portion of the image forming apparatus main body 1.

The sheet discharge apparatus 3 will be explained here in detail. As shown in FIG. 2, the sheet discharge apparatus 3 has a plurality of stack trays 26*a*-26*e* and can sort and stack the sheets received from the image forming apparatus main body 1. The sheet discharge apparatus 3 has a first sheet conveying path 35 and a plurality of second sheet conveying paths 36*a*-36*d* branched from the first sheet conveying path 35. Further, the sheet discharge apparatus 3 has switching members 24*a*-24*d* which switch a sheet conveying direction in the respective branch portions of the sheet conveying paths 35, 36. The switching members 24*a*-24*d* can be switched to first positions for guiding a sheet to the first sheet conveying path 35 and second positions which guide a sheet to the second sheet conveying paths 36 by turning about turning fulcrums in the respective branch portions. Note that although the turnable switching member is exemplified here, the switching member is not limited thereto. That is, other switching member may be used as long as it can move to the first position and the second position in the branch portion. Further, the sheet discharge apparatus 3 is provided with an openable/closable exterior cover (hereinafter, referred to as jam processing door) 28 so that the peripheries of the branch portions of the sheet conveying paths 35, 36 can be opened for jam processing.

When the switching members 24*a*-24*d* are located at the first positions shown in FIG. 2, the sheets, which are sent to the sheet discharge apparatus 3, are sequentially conveyed in the first sheet conveying path 35 by a pair of inlet rollers 23, a pair of intermediate rollers 25, and a pair of discharge roller 27*a* and finally stacked on the uppermost tray 26*a*. Note that the first positions shown in FIG. 2 are home positions of the switching members 24.

Figure 3:
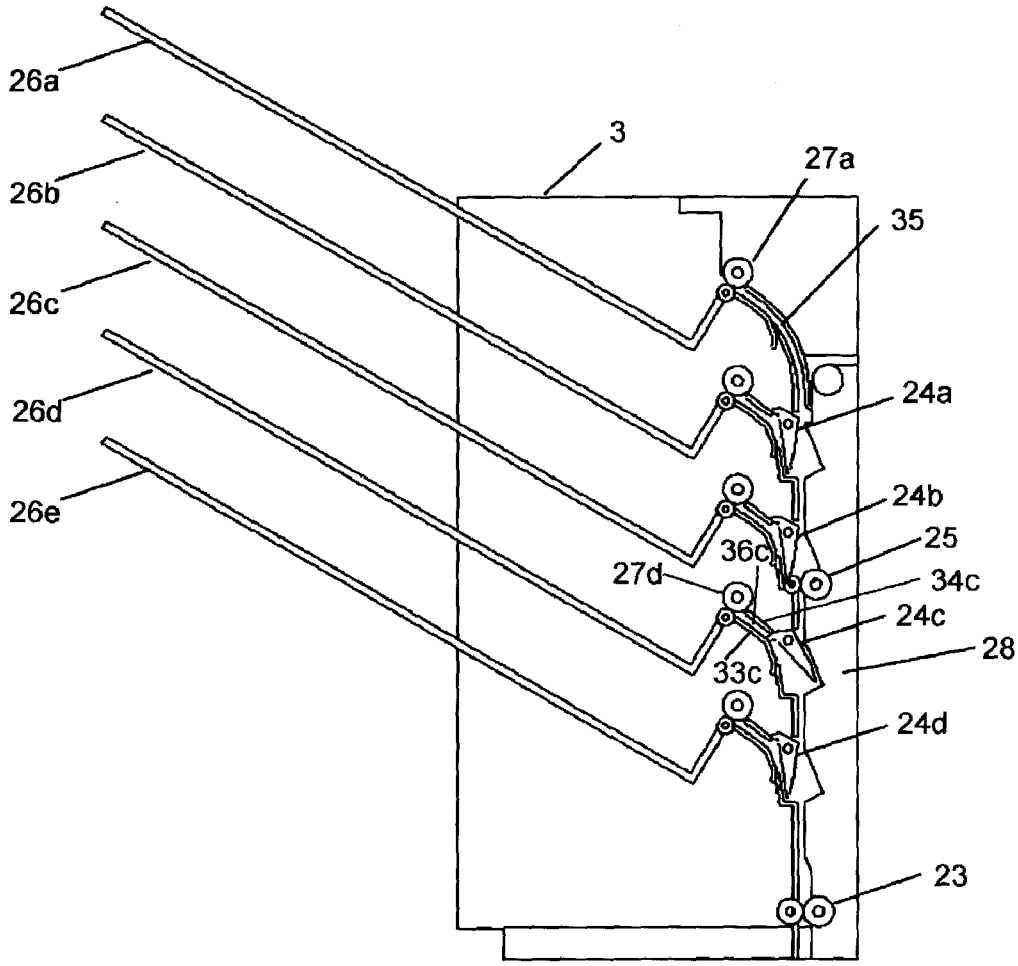
FIG. 3 is a sectional view of the sheet conveying apparatus.

Next, a case in which a sheet is discharged to a tray other than the uppermost tray will be explained. FIG. 3 shows the positional relation of the switching members 24*a*-24*d* when a sheet is discharged to the tray 26*d*. In FIG. 3, the switching member 24*a*, 24*b*, 24*d* are located at the first positions as the home positions. The switching member 24*c* is turned from the first position (home position) to the second position (the position of the switching member 24*c* shown in FIG. 3) by an actuator (not shown) such as a solenoid and the like. The actuator is disposed to each of the switching members 24*a*-24*d* so that they can independently switch the positions thereof. The actuators change sheet discharge destinations by switching the respective switching members to appropriate positions in such a manner that the operation timings of the actuators are controlled by a controller (not shown) based on sheet discharge destination designating information sent from the image forming apparatus main body 1. When the switching members 24*a*-24*d* are placed in the positional relation shown in FIG. 3, the sheet conveyed by the pair of inlet rollers 23 is guided to the second sheet conveying path 36*c* by the switching member 24*c*. Then, the sheet is conveyed toward a pair of discharge rollers 27*d* while being guided by sheet conveying guide 33*c*, 34*c* constituting the second sheet conveying path 36*c* and finally stacked on the tray 26*d*. Note that the case in which the sheet is discharged to the other trays 26*b*, 26*c*, 26*e* is different from the above case only in that a different switching member is turned to the second position, explanation of the case is omitted.

The arrangements of the switching member, a first regulation member, and a second regulation member will be explained below in detail. First, the relation between the switching member and the first regulation member will be explained below.

Figure 4:
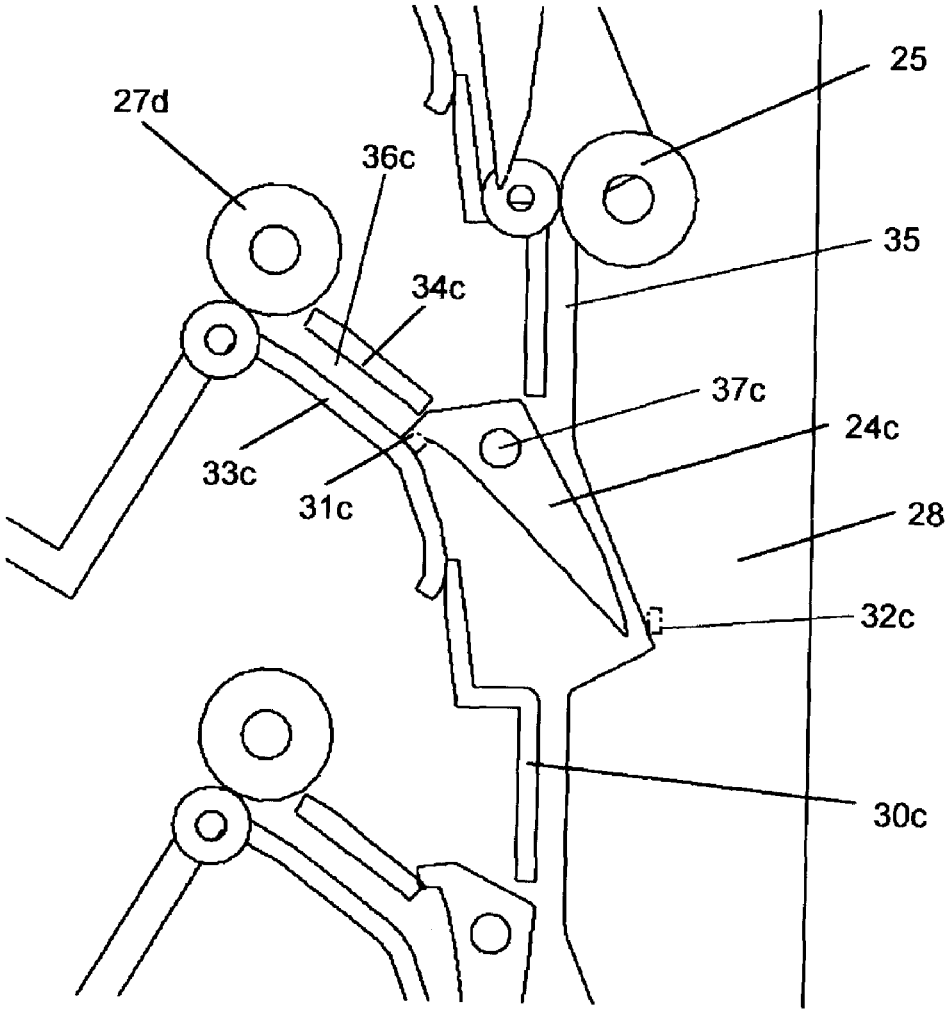
FIG. 4 is partial sectional view of the sheet conveying apparatus according to the first embodiment.

FIG. 4 shows an enlarged view of the periphery of the switching member. Although the switching member 24*c* is explained here as an example, the other switching members 24*a*, 24*b*, 24*d* are also arranged likewise. As shown in FIG. 4, a projection 31*c* is disposed to the switching member 24*c* on the downstream side in the conveying direction thereof. The projection 31*c* is disposed at a position where it projects into the sheet conveying path 36*c* in a sheet thickness direction and disposed outside of a sheet conveying region in a width direction orthogonal to the sheet conveying direction. When the switching member 24*c* is turned by the actuator (not shown) from the first position (home position) to the second position, the projection 31*c* is abutted against the sheet conveying guide 33*c* confronting therewith. The sheet conveying guide 33*c*, against which the projection 31*c* is abutted, is the first regulation member for regulating the turn of the switching member which turns in the direction from the first position to the second position. When the projection 31*c* of the switching member 24*c* is abutted against the sheet conveying guide 33*c*, the switching member 24*c* is stopped at the position (the second position) and the position thereof is determined. With this operation, a gap having a first interval, through which the sheet can pass, is formed between the switching member 24*c* and the sheet conveying guide 33*c* (the second sheet conveying path 36*c*). FIG. 4 shows the state of the switching member 24*c* switched to the second position.

Note that the projection 31*c* may be disposed to the sheet conveying guide 33*c* side in place of being disposed to the switching member 24*c*. In this case, the projection 31*c* acts as the first regulation member.

Next, the arrangements of the switching member and the second regulation member will be explained.

Figure 5:
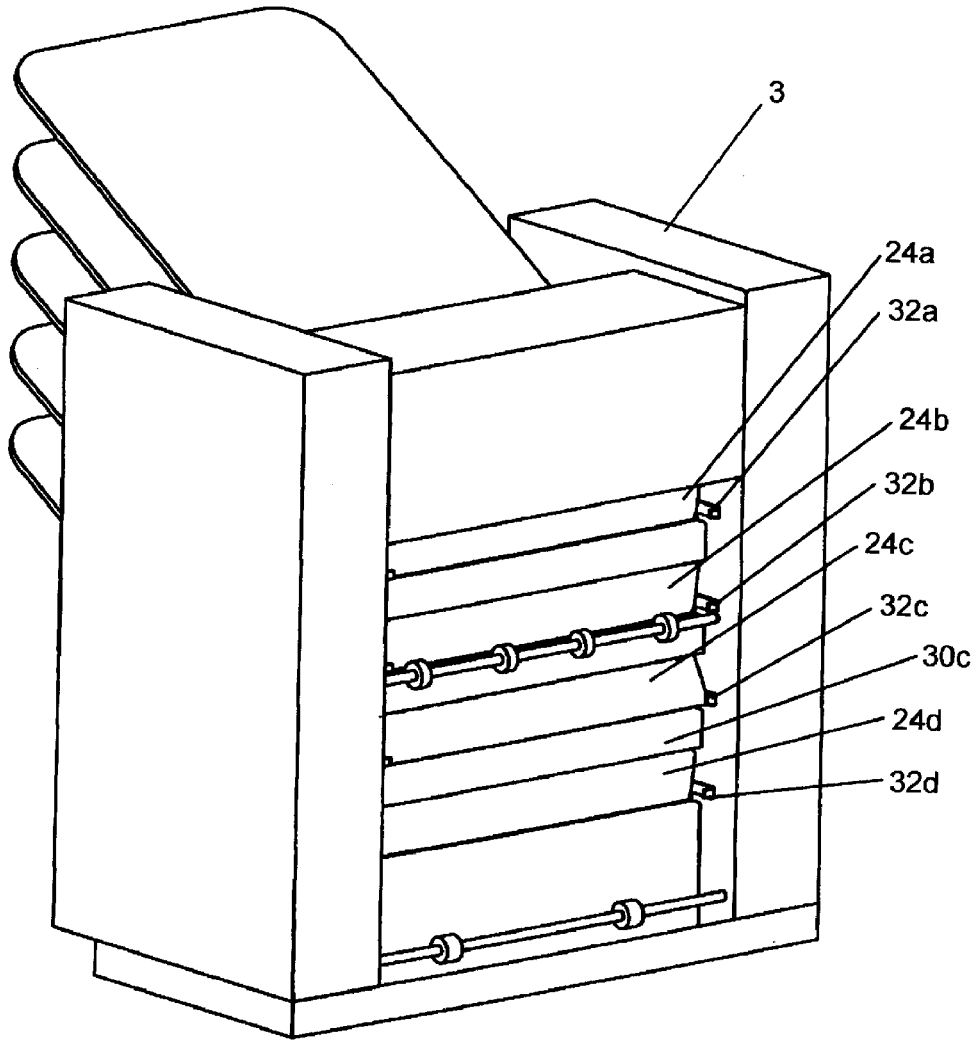
FIG. 5 is a perspective view of the sheet conveying apparatus according to the first embodiment.

FIG. 1 is a view showing that the jam processing door 28 is opened from the state shown in FIG. 4. FIG. 5 is an overall perspective view of the sheet discharge apparatus when the jam processing door is opened. However, the jam processing door is not shown so that an opening can be easily observed. As shown in FIG. 1, a stopper 32*c* is disposed in the vicinity of the extreme end of the switching member 24*c* on the upstream side thereof in a sheet conveying direction. The stopper 32*c* is the second regulation member for regulating the turn of the switching member 24*c* by being abutted against the switching member 24*c* which turns in the direction from the first position to the second position. The stopper 32*c* is disposed at a position where it confronts the switching member 24 through a gap when the switching member 24*c* is abutted against the sheet conveying guide 33 (the first regulation member). As described later, the position, where the stopper 32*c* is disposed, is a position at which the stopper 32*c* regulates the turn of the stopper 32*c* be being abutted thereagainst when the stopper 32*c* is flexed and further turned from the second position by the strong turning force generated when a jammed sheet is extracted to process jam. With this arrangement, breakage of the switching member 24*c* can be prevented. Further, a gap having a second interval through which a sheet can pass can be secured between the switching member 24*c* and the sheet conveying guide 33*c* (the second sheet conveying path 36*c*) by suppressing the flex of the switching member 24*c* when the jammed sheet is extracted in an approximately horizontal direction. Although the second interval is smaller than the first interval formed when the projection 31*c* of the switching member 24*c* is abutted against the sheet conveying guide 33*c*, it is sufficient for the sheet to pass therethrough. With this arrangement, the jammed sheet can be easily extracted without being clamped between the switching member 24*c* and the sheet conveying guide 33*c*, and breakage of the sheet can be also prevented. Further, as shown in FIG. 1, the stopper 32*c* is disposed at a position farther from the turning fulcrum 37*c* of the switching member 24*c* than the sheet conveying guide 33*c*. Note that only the arrangement of the periphery of the switching member 24*c* is explained here as an example, the peripheries of the other switching members 24*a*, 24*b*, 24*d* are also arranged likewise.

Further, as shown in FIG. 4, the stopper 32*c* is disposed at a position where it does not project into the sheet conveying path 35 in the sheet thickness direction and disposed inside the sheet conveying region in the width direction orthogonal to the sheet conveying direction. That is, when the jam processing door 28 is closed and the sheet conveying path is formed, the stopper 32*c* gets into a conveying rib formed to the jam processing door 28 and does not prevent conveyance of a sheet. Note that, as shown in FIG. 5, the stoppers 32*a*, 32*b*, 32*d* acting as the second regulation member are disposed in correspondence to the respective switching members 24*a*, 24*b*, 24*d*. Further, although FIG. 5 shows the stoppers 32*a*-32*d* only on one side, similar stoppers are also disposed on a confronting side in a longer direction (axial direction). Further, the number of parts is reduced by providing the stoppers 32 integrally with a sheet guide member 30 on the apparatus main body side for connecting between the switching members 24.

Figure 6:
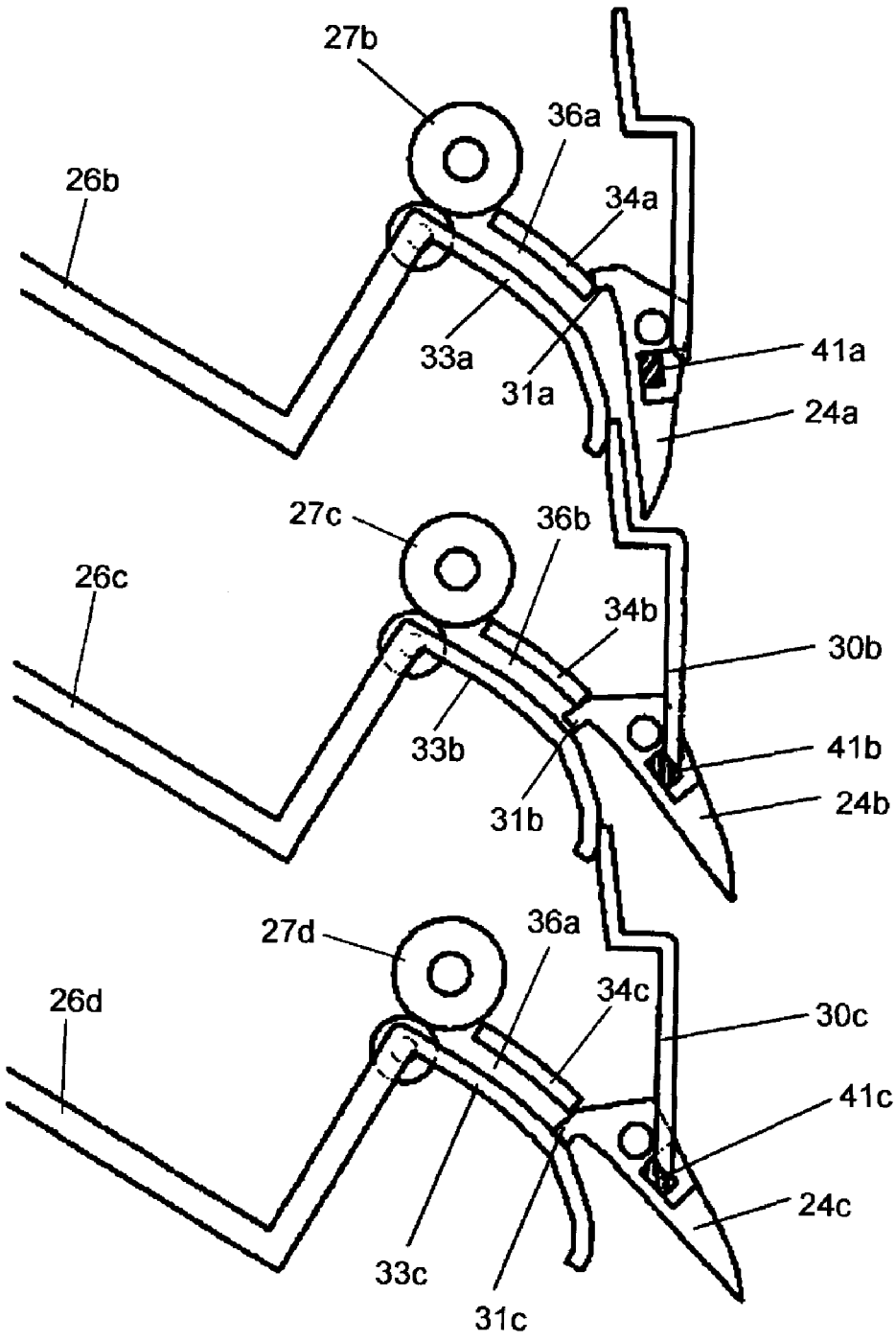
FIG. 6 is a partial sectional view of the sheet conveying apparatus according to the first embodiment.

Further, as shown in FIG. 6, elastic members 41*a*-41*d* are disposed to the respective the switching members 24*a*-24*d* integrally therewith. The elastic members have a purpose of improving operation stability by absorbing a shock when the switching members 24*a*-24*d* are switched and a purpose of suppressing impact noise and are specifically composed of rubber, a shock absorbing pad, and the like. In FIG. 6, the switching member 24*a* is located at the first position (home position). The switching member 24*b* is located at a position between the first position (home position) and the second position, and the elastic member 41*b* of the switching member 24*b* is abutted against a part of the sheet guide member 30*b* at the position. The switching member 24*c* is located at the second position. At the time, the elastic member 41*c* is pressed by the part of the sheet guide member 30*c* and deformed thereby. That is, the elastic member 41 is disposed such that it is abutted against the sheet guide member 30 before the projection 31 disposed to the switching member 24 is abutted against the sheet conveying guide 33 confronting therewith. Accordingly, the switching member 24 is continuously turned while the elastic member 41 is being deformed and stopped when the projection 31 is abutted against the sheet conveying guide 33. Note that the elastic member may be disposed to a part of the apparatus integrally therewith in place of being disposed to the switching member so that a part of the switching member is abutted against the elastic member. Note that since FIG. 6 is used to explain the operation of the switching member 24, the switching member 24*a*-24*c* do not actually take the above attitudes, respectively.

With the arrangement describe above, there can be provided the sheet conveying apparatus having high conveyance stability and a jam processing property and capable of preventing breakage of a jammed sheet and the switching members.

Specifically, the projection 31 disposed to the switching member 24 is abutted against the sheet conveying guide 33 confronting therewith so that the switching member 24 is regulated by the second position. With this arrangement, since a positional relation is determined by the parts constituting the sheet conveying path, the sheet conveying path is formed at a stable position, thereby high conveyance stability can be obtained.

When it is intended to extract the jammed sheet in an approximately horizontal direction in the jam processing, moment acts on the switching member 24 counterclockwise in FIG. 1. The sheet conveying space is secured in such a manner that the projection 31 is abutted against the sheet conveying guide 33 when a sheet is conveyed. However, when a large load is applied upstream of the switching member 24 by the sheet extracted in the jam processing, the switching member may be flexed in the downstream central portion thereof in the sheet width direction which is not supported by the projection 31 and abutted against sheet conveying guide 33. When the switching member 24 is abutted against the sheet conveying guide 33*a* in the state that the jammed sheet is located therebetween, the jammed sheet is clamped therebetween and cannot be extracted. Further, when it is intended to forcibly extract the jammed sheet, it may be broken and a part of it may remain in the apparatus. In the worst case, there is also a possibility the switching member is broken.

To cope with the above problem, a stopper 32 is disposed upstream of the switching member 24, on which a load is applied when the jammed sheet is extracted so that the switching member 24 is supported, thereby the load applied on the switching member can be reduced. Accordingly, the flex of the switching member 24, on which the load is applied, can be reduced, thereby the switching member 24 is not abutted against the sheet conveying guide 33. With this arrangement, the jammed sheet can be prevented from being clamped between the switching member 24 and the sheet conveying guide 33 and not being extracted therefrom. As a result, an extraction force can be reduced in the jam processing. Further, breakage of the jammed sheet can be also prevented. Accordingly, breakage of the switching member 24 can be also prevented.

Further, as shown in FIG. 5, since the stopper 32, which determines the limit of turn of the switching member 24, is disposed at the position which can be observed from the user, the user can visually confirm the limit of turn of the switching member. With this arrangement, it can be also expected to change the extracting direction of the jammed sheet from a direction in which a load is applied on the switching member (approximately horizontal direction) to a direction in which the load is not applied (obliquely lower direction).

Further, since the stopper 32 is disposed in the conveying rib, conveyance of a sheet is not interfered by the stopper. As a result, since the stopper can be disposed in the conveying region in the sheet thickness direction, thereby the apparatus can be reduced in size. At the same time, since the switching member can be supported by the stopper up to a portion nearer to the central portion thereof, there is also an effect of preventing flex of the switching member.

Further, since the elastic member 41 is provided integrally with the switching member 24 as described above, it is possible to absorb the shock caused when the projection 31 of the switching member is abutted against the sheet conveying guide 33, thereby the switching member 24 is promptly moved to the second position and stopped so that conveyance stability can be improved. Further, since shock noise, which is caused when the projection 31 is abutted against the sheet conveying guide 33, can be reduced, the apparatus can be operated quietly.

Second Embodiment

Figure 7:
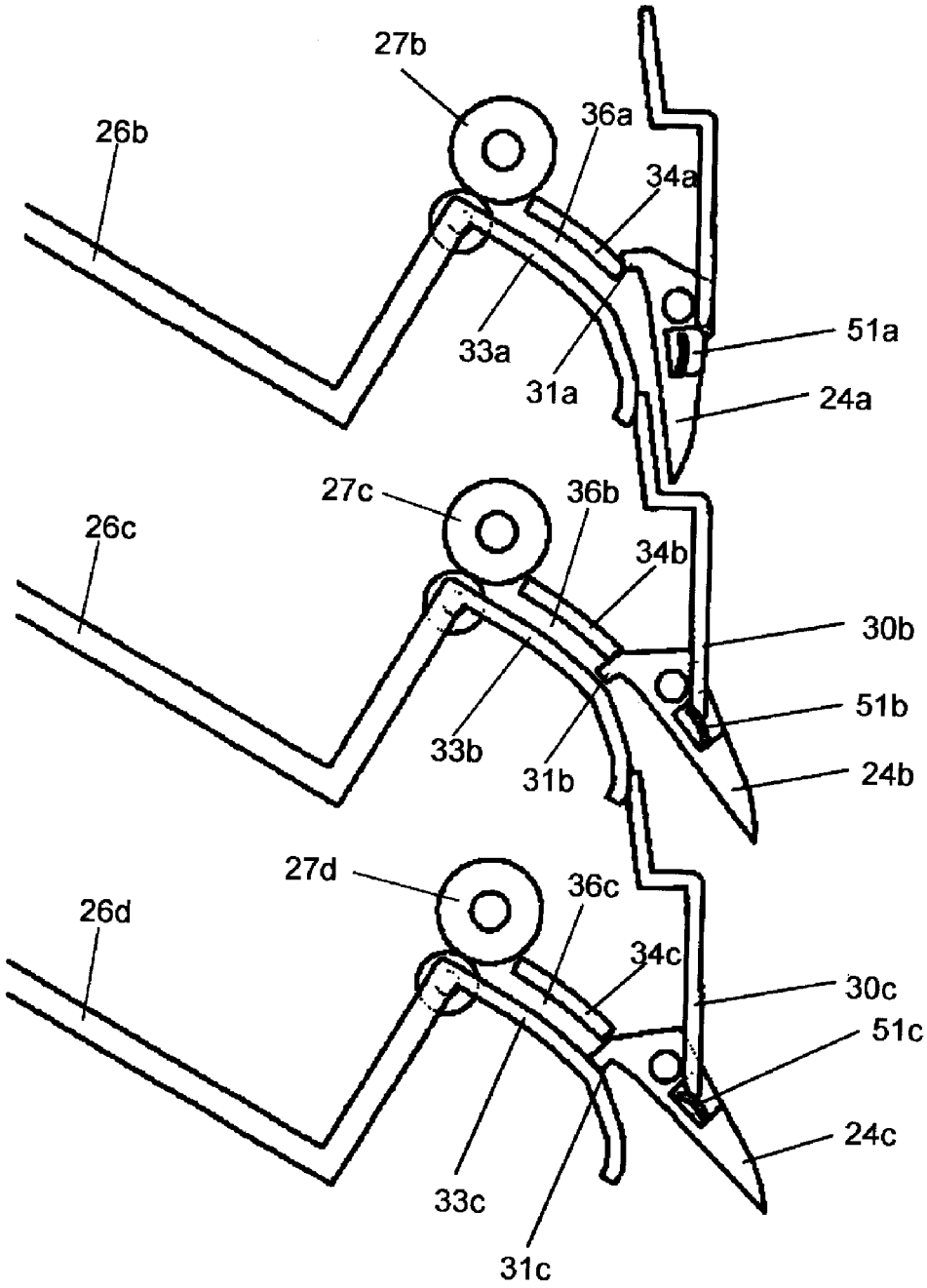
FIG. 7 is a partial sectional view of a sheet conveying apparatus according to a second embodiment.

Next, a second embodiment will be explained. FIG. 7 is a sectional view of a sheet conveying apparatus according to the second embodiment. Although the first embodiment described above exemplifies the arrangement in which the elastic member is provided integrally with the switching member, the arrangement in which the switching member includes the elastic member integrally therewith is not limited to the above embodiment.

In the second embodiment, plate-spring-shaped elastic portions 51 (51*a*, 51*b*, 51*c* shown in FIG. 7) are disposed to parts of the respective switching members as shown in FIG. 7. That is, a part of each switching member has a structure having elastic force. Note that, although FIG. 7 shows only the peripheries of the switching members 24*a*, 24*b*, 24*c*, the peripheries of the other switching members are also arranged likewise.

In FIG. 7, the switching member 24*a* is located at the first position (home position). The switching member 24*b* is located at a position between the first position (home position) and the second position, and the elastic portion 51*b* is abutted against a part of the sheet guide member 30*b* at the portion. The switching member 24*c* is located at the second position. At the time, the elastic portion 51*c* is deformed by being pressed by a part of the sheet guide member 30*c*. That is, the elastic portion 51 is disposed such that it is abutted against the sheet guide member 30 before the projection 31 disposed to the switching member 24 is abutted against the sheet conveying guide 33 confronting therewith. Accordingly, the switching member 24 is continuously turned while the elastic member 51 is being deformed and stopped when the projection 31 is abutted against the sheet conveying guide. Note that the elastic portion may be formed to a part of the apparatus integrally therewith in place of being disposed to the switching member so that a part of the switching member is abutted against the elastic portion. Note that FIG. 7 is also used to explain the operation of the switching member 24, and the switching member 24*a*-24*c* do not actually take the above attitudes, respectively.

With the arrangement, the number of parts can be more reduced and cost can be decreased in addition to the advantages of the first embodiment described above.

Third Embodiment

Next, a third embodiment will be explained. Here, only the components whose arrangements are different from those described in the first embodiment will be explained. Accordingly, it is assumed that the portions not particularly described here have the same arrangements as those described in the first embodiment.

Figure 8:
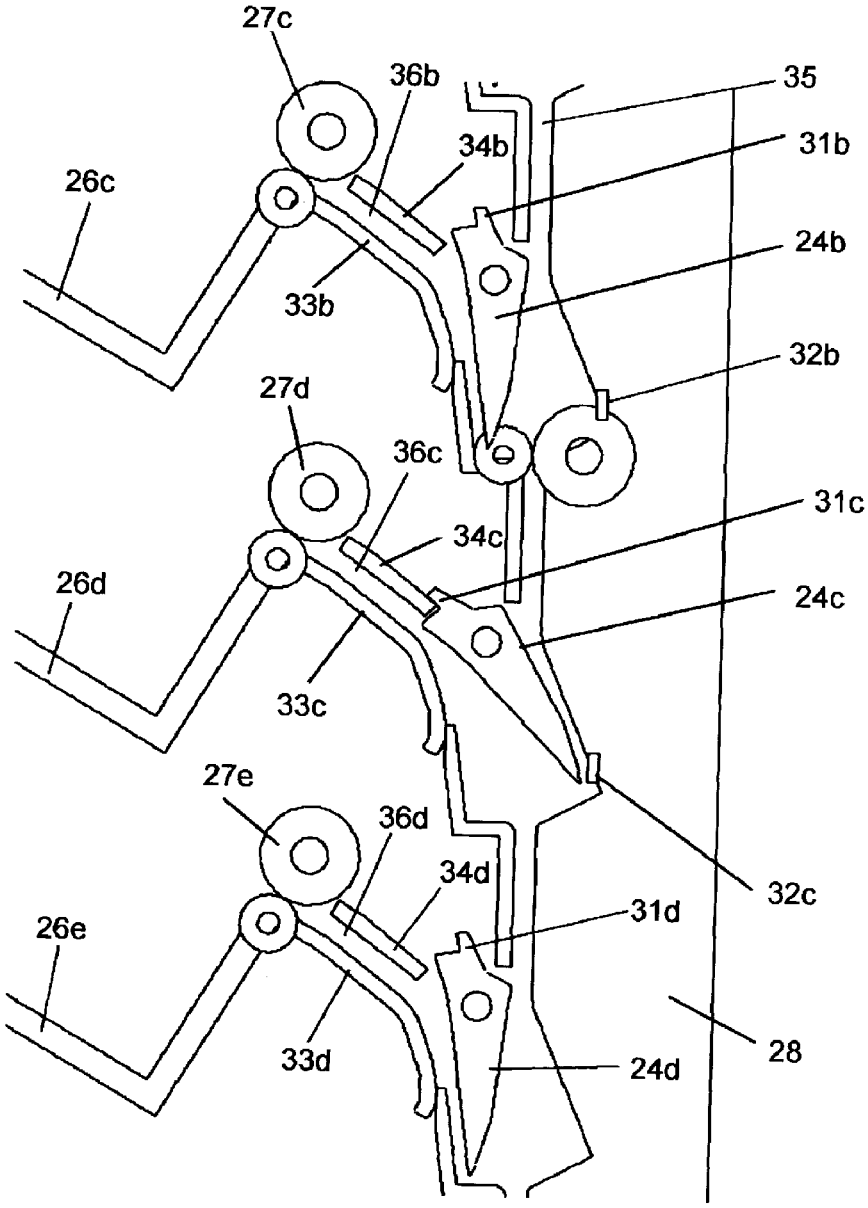
FIG. 8 is a partial sectional view of a sheet conveying apparatus according to a third embodiment.

FIG. 8 is a sectional view of a sheet conveying apparatus according to the third embodiment. In the embodiment, the projection 31 provided with the switching member 24 is disposed at a position where it does not project into the sheet conveying path 36 in the sheet thickness direction. Further, the projection is disposed inside the sheet conveying region in width direction orthogonal to the sheet conveying direction. Note that, although FIG. 8 shows only the peripheries of the switching member 24*b*, 24*c*, 24*d*, the peripheries of the other switching members are also arranged likewise.

In FIG. 8, the switching member 24*b* is located at the first position (home position). The switching member 24*c* is located at a position after it is turned from the first position (home position) to the second position by an actuator (not shown) as a moving unit. The projection 31*c* is disposed to the switching member 24*c*, and when the projection 31*c* is abutted against the sheet conveying guide 34*c* disposed downstream of the switching member 24*c*, the switching member 24*c* stop turning and the position thereof is determined.

Since it is not necessary to form a space, in which the projection is abutted, to the outside of the sheet conveying region by disposing the projection 31 provided with the switching member 24 to the above position, the apparatus can be more reduced in size in the sheet width direction.

Further, since the positional relation of the joint portion of the sheet conveying path from the switching member 24 to the sheet conveying guide 34 can be stabilized by abutting the projection 31 against the sheet conveying guide 34, occurrence of jam and the like in a joint can be prevented.

Other Embodiment

Although the embodiments described above exemplify the second four sheet conveying paths branched from the first sheet conveying path, the number of the branched sheet conveying paths is not limited thereto. Although the sheet discharge apparatus is exemplified as the sheet conveying apparatus, the sheet conveying apparatus is not limited thereto.

Further, the embodiments described above exemplify the printer as the image forming apparatus, the present invention is not limited thereto, and the mage forming apparatus may be, for example, other image forming apparatuses, for example, a copy machine, a facsimile apparatus, and the like or may be other image forming apparatuses such as a composite machine, in which the functions of the above apparatuses are combined, and the like. The same advantages can be obtained by applying the present invention to the sheet conveying apparatus used to these image forming apparatuses.

Further, the embodiments described above exemplify the sheet conveying apparatus detachably mounted on the image forming apparatus, the present invention is not limited thereto. For example, the sheet conveying apparatus may be a sheet conveying apparatus provided integrally with an image forming apparatus, and the same advantages can be obtained by applying the present invention to the sheet conveying apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2007-015799, filed Jan. 26, 2007, No. 2008-008740, filed Jan. 18, 2008 which are hereby incorporated by reference herein in their entirety.

What is claimed is:

1. A sheet conveying apparatus, comprising:

a first sheet conveying path;

a second sheet conveying path branched from the first sheet conveying path;

a switching member which moves between a first position to guide a sheet to the first sheet conveying path and a second position to guide the sheet to the second sheet conveying path in a branch portion of the first sheet conveying path and the second sheet conveying path;

a first regulation member which regulates the switching member at the second position to form a gap through which the sheet can pass to the second sheet conveying path; and a second regulation member which regulates the switching member to secure the gap formed by the first regulation member, permitting a passage of the sheet when the switching member regulated at the second position is deformed by a force in a direction from the first position to the second position.

2. A sheet conveying apparatus according to claim 1, wherein the second regulation member is disposed at a position where the second regulation member does not project into a sheet conveying region in a sheet thickness direction so as to prevent the second regulation member from obstructing a sheet conveyance.

3. A sheet conveying apparatus according to claim 1, wherein the switching member comprises a projection abutted against the first regulation member, and the projection is disposed at a position where the projection is disposed outside of a sheet conveying region in a width direction orthogonal to a sheet conveying direction so as to prevent the projection from obstructing a sheet conveyance.

4. A sheet conveying apparatus according to claim 1, wherein the switching member comprises a projection abutted against the first regulation member, and the projection is disposed at a position where the projection does not project into a sheet conveying region in a sheet thickness direction so as to prevent the projection from obstructing a sheet conveyance.

5. A sheet conveying apparatus according to claim 1, comprising a cover capable of opening a periphery of the branch portion to recover jams, and the second regulation member is disposed on a side where a jammed sheet is extracted with respect to the switching member.

6. A sheet conveying apparatus according to claim 5, wherein the second regulation member is disposed at a position where the second regulation member can be visually observed from the opening of the periphery of the branch portion.

7. An image forming apparatus, comprising an image forming portion which forms an image on a sheet, and a sheet conveying apparatus, wherein the sheet conveying apparatus comprises:

a first sheet conveying path;

a second sheet conveying path branched from the first sheet conveying path;

a switching member which moves between a first position which guides a sheet to the first sheet conveying path and a second position which guides the sheet to the second sheet conveying path in a branch portion of the first sheet conveying path and the second sheet conveying path;

a first regulation member which regulates the switching member at the second position to form a gap through which the sheet can pass to the second sheet conveying path; and a second regulation member which regulates the switching member to secure the gap formed by the first regulation member, permitting a passage of the sheet when the switching member regulated at the second position is deformed by a force in a direction from the first position to the second position.

8. An image forming apparatus according to claim 7, wherein the second regulation member is disposed at a position where the second regulation member does not project into a sheet conveying region in a sheet thickness direction so as to prevent the second regulation member from obstructing a sheet conveyance.

9. An image forming apparatus according to claim 7, wherein the switching member comprises a projection abutted against the first regulation member, and the projection is disposed at a position where the projection is disposed outside of a sheet conveying region in a width direction orthogonal to a sheet conveying direction so as to prevent the projection from obstructing a sheet conveyance.

10. An image forming apparatus according to claim 7, wherein the switching member comprises a projection abutted against the first regulation member, and the projection is disposed at a position where the projection does not project into a sheet conveying region in a sheet thickness direction so as to prevent the projection from obstructing a sheet conveyance.

11. An image forming apparatus according to claim 7, comprising a cover capable of opening a periphery of the branch portion to recover jams, and the second regulation member is disposed on a side where a jammed sheet is extracted with respect to the switching member.

12. An image forming apparatus according to claim 11, wherein the second regulation member is disposed at a position where the second regulation member can be visually observed from the opening of the periphery of the branch portion.

* * * * *